United States Patent [19]

Clark

[11] 4,266,692

[45] May 12, 1981

[54] SEALED CONTAINER HAVING A DEFORMABLE ELONGATE MEMBER IN THE SEAL AREA

[75] Inventor: James A. Clark, Honeoye Falls, N.Y.

[73] Assignee: Bausch & Lomb Incorporated, Rochester, N.Y.

[21] Appl. No.: 931,639

[22] Filed: Aug. 7, 1978

[51] Int. Cl.[3] ..... B65D 33/36; B65D 81/32

[52] U.S. Cl. ..... 222/94; 206/616; 215/355; 222/107; 222/563

[58] Field of Search ..... 222/107, 94, 563; 206/616, 617, 618, 610, 632; 229/62.5, 62, 63; 215/355

[56] References Cited

U.S. PATENT DOCUMENTS

| | | | |
|---|---|---|---|
| 1,093,985 | 4/1914 | French | 112/405 |
| 1,607,626 | 11/1926 | Hopkinson | 206/69 |
| 1,945,885 | 2/1934 | Darlington | 222/94 |
| 2,087,236 | 7/1937 | Anders | 426/81 |
| 2,172,930 | 9/1939 | Bensel | 229/17 B |
| 2,293,952 | 8/1942 | Stroop | 229/51 S |
| 2,364,903 | 12/1944 | Howard | 426/83 |
| 2,676,702 | 4/1954 | Whitefoot, Jr. | 229/48 T X |
| 2,712,392 | 7/1955 | Jamieson | 222/563 X |
| 2,760,630 | 8/1956 | Lakso | 206/530 |
| 3,157,312 | 11/1964 | Kitterman | 222/1 |
| 3,255,925 | 6/1966 | Park | 222/107 |
| 3,411,968 | 11/1963 | Vilutis et al. | 156/174 |
| 3,426,959 | 2/1969 | Lemelson | 229/65 |
| 3,680,689 | 8/1972 | Grundschober et al. | 206/616 X |
| 3,797,493 | 3/1974 | Saudek | 206/616 X |
| 3,891,775 | 6/1975 | Murray et al. | 229/62.5 X |

*Primary Examiner*—F. J. Bartuska

*Attorney, Agent, or Firm*—Frank C. Parker; John S. Norton

[57] ABSTRACT

A sealed container having matter, such as a liquid, paste or powder effectively sealed in the container, has an elongate stopper member transversely disposed in the seal. The seal grips the elongate stopper member but is not sealed thereto. The elongate stopper member has one end extending through the seal and the other end extending outside the container. The outside end of the stopper member may be grasped and pulled. The end extending into the container will be caused to be withdrawn through the container seal, leaving an opening into the container through the space formerly occupied by the elongate stopper member. The matter within the container may then be expelled through the opening.

8 Claims, 18 Drawing Figures

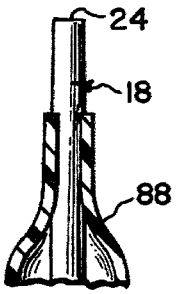
FIG. 9
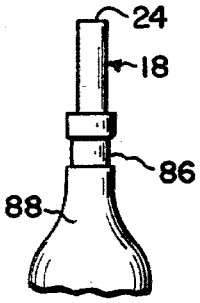
FIG. 10
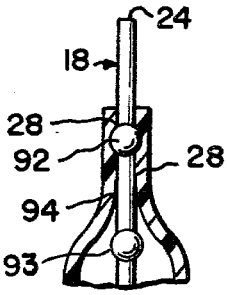
FIG. 11
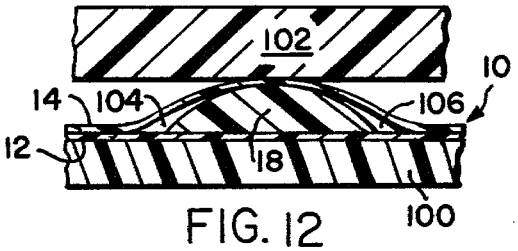
FIG. 12
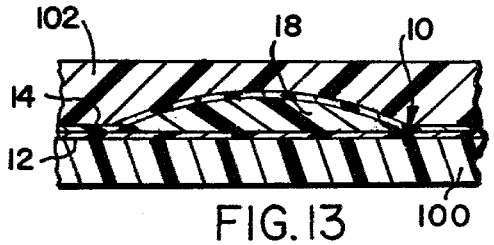
FIG. 13
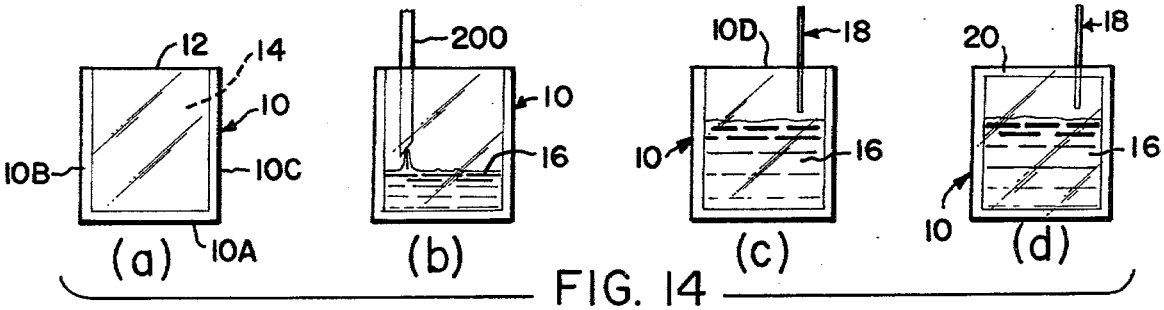
FIG. 14
FIG. 4
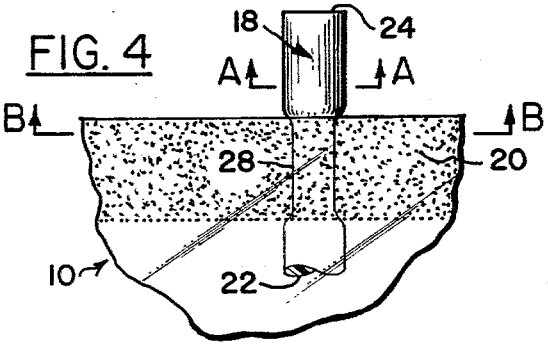
FIG. 4B
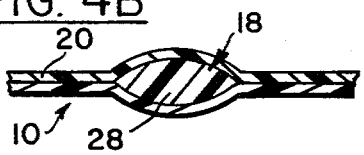
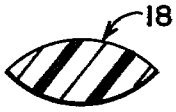
FIG. 4A
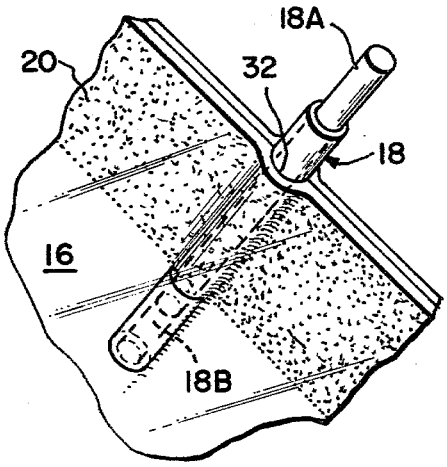
FIG. 15

SEALED CONTAINER HAVING A DEFORMABLE ELONGATE MEMBER IN THE SEAL AREA

BACKGROUND OF THE INVENTION

This invention relates generally to packaging devices, and more specifically to flexible packages for containing and dispensing liquids, solids, pastes and powders. The invention is particularly applicable to sterilizable, sterility maintaining packages for sterile products, such as; for example, contact lens saline solution.

One of the major advances in modern packaging has resulted from the mass production of flexible plastic pouches used to contain a wide variety of materials. Their low cost and ease of use have facilitated the widespread use of many new products, including those in the medical field. One of the problems associated with such packages, however, particularly when they are used as liquid containers, is how to easily open and dispense the material contained therein. In addition, in the case of packages for sterile products, a problem has been how to open and dispense the sterile material contained therein without contamination from the package.

Previous attempts to overcome these difficulties are illustrated in such patents as the following:

| Pat. No. | Title | Inventor | Issue Date |
|---|---|---|---|
| 1,093,985 | Detachable secured Label | J. French | Apr. 21, 1914 |
| 1,607,626 | Latex shipping bale | E. Hopkinson | Nov. 23, 1926 |
| 1,945,885 | Device for opening Containers | H. S. Darlington | Feb. 6, 1934 |
| 2,087,236 | Individually Wrapped bag package | E. R. Anders | July 20, 1937 |
| 2,172,930 | Dispensing Container | D. Bensel | Sept. 12, 1939 |
| 2,293,952 | Package | J. H. Stroop | Aug. 25, 1942 |
| 2,364,903 | Bag for infusing Material | S. R. Howard | Dec. 12, 1944 |
| 2,676,702 | Sanitary package | R. Whitefoot, Jr. | Apr. 27, 1954 |
| 2,760,630 | Foil covered Ampoule | E. E. Lakso | Aug. 28, 1956 |
| 3,157,312 | Decoration Dispenser and the Method of making, Filling, and Dispensing from The same | D. M. Kitterman | Nov. 17, 1964 |
| 3,411,968 | Method of Incorporating a Tear string in a Thermoplastic web | L. J. Vilutis et al | Nov. 19, 1963 |
| 3,426,959 | Packaging assembly | J. H. Lemelson | Feb. 11, 1969 |
| 3,680,689 | Enclosure with Progressively Destructible seal | F. Grundschober et al | Aug. 1, 1972 |
| 3,797,493 | Single use Container, Especially for Pharmaceutical Material | E. C. Saudek | Mar. 19, 1974 |

While the packages illustrated in the foregoing patents have met with some success none of them have provided a practical low cost package for liquids with a dispensing device integrally formed therein which allows the liquid to be dispensed without puncturing or tearing the package. This has posed problems in the case of sterile products where the puncturing or tearing of the package leaves an unsterile edge or surface over which the product must pass.

Accordingly, it is an object of the present invention to provide packages which may be easily opened and the material contained therein easily dispensed. More specific objects are:

- to provide such packages which can be sterilized and the material contained therein dispensed without contamination;
- to provide such packages in a form which contains several materials which may be retained separately until use is desired; and
- to provide such packages in a form which is easy and inexpensive to manufacture.

SUMMARY OF THE INVENTION

The present invention comprises a container formed of a sealable material with adjacent portions of the container sealed together to close the container, thereby effectively sealing a quantity of matter within the container, having an elongate stopper member disposed transversely through the seal between the adjacent portions of the package. The sealed portions are fused, cemented or otherwise joined together so as to snugly surround and frictionally engage the elongate stopper member. However, in a preferred embodiment, the elongate stopper member is not itself fused or cemented to the package at the seal. Fusion is defined by Webster's Seventh Collegiate Dictionary as, "the act or process of liquifying or rendering plastic by heat." The elongate stopper member has one end extending through the seal and the other end extending outside the container in order to allow the member to be grasped and withdrawn from between the sealed portions without rupturing or tearing the sealed portions. When the elongate stopper member is withdrawn, an opening into the container through the space formerly occupied by the elongate member is provided. Matter within the container may be expelled through this opening.

In a preferred embodiment the container is formed of a plastic material having adjacent sheet portions heat sealed together. Alternatively, the container may be formed from plastic tube stock. The container may take the form, among others, of a film plastic envelope or it may comprise a blow-molded plastic bottle or vial. The envelope may be a homopolymer, a copolymer, co-extruded or laminated, such as polypropylene, polyvinylidene chloride, polyamide or other well known packaging materials. In addition, a foil laminate may be integrally attached thereto in order to reduce water vapor transmission. While in a preferred embodiment, the entire container may be constructed of a flexible material, in some instances the container may be constructed of a rigid material which is compressed about the elongate stopper member during the sealing process. This compression may be accomplished through the use of machinery or crimping devices such as a wire crimp about the closure portion of the package.

In a preferred embodiment, the elongate stopper member is composed of a substantially incompressible but deformable material which constricts laterally and stretches longitudinally when it is pulled away from the container. This longitudinal stretching reduces the cross section of the stopper allowing it to be withdrawn from the container. The thickness and cross-sectional area of the elongate stopper member is selected to provide an opening of the desired size. In a preferred embodiment the stopper is of a sufficient cross-sectional area so that when removed, a fine stream of matter may be expelled from within the container and directed as desired. Alternatively, matter may be dispensed drop by drop as required. In a preferred embodiment the elongate member is comprised of a flexible elastomeric material. Alternatively, the stopper member may be constructed of flexible plastic material. In a preferred embodiment the stopper is comprised of silicone rubber which can withstand temperatures of 400° F. thereby resisting fusion to the sealable material of the container as well as remaining elastic and non-brittle at these temperatures. At the same time silicone rubber easily deforms for removal from the container. An example of such a silicone rubber is Minnesota Rubber Co. No. 71115 which is a vulcanized cross-linked silicone which easily withstands prolonged exposure to temperature in excess of 400° F.

An element of the invention is the propensity of the elongate stopper member to deform both longitudinally and laterally when force is applied during sealing across a portion of the elongate stopper member. When the force of the sealing bars is applied across the seal area of the container, the stopper deforms both towards its ends, which are not under such force, and laterally. The cross-sectional area of the elongate stopper member in the seal area is relatively smaller when under such force than the cross-sectional area of the elongate stopper member when not under force. Since the stopper is elastic, when force is removed from the seal area, the stopper tends to return to its original shape, expanding at the seal area and tightly engaging therein. As a result, since the cross-sectional area of the resultant opening through the seal is smaller than the normal cross-sectional area of the elongate stopper member, the elongate stopper member acts as a hermetic seal of the opening between the inside and outside of the package.

In order to effect elastic deformation of the stopper member to seal the container, it must be constructed of an elastic material, such as the aforementioned silicone rubber, which will deform in the manner described. A second method for effecting the elastic deformation of the stopper member is through the use of a stopper having a selected cross-sectional shape, such as a somewhat flattened ellipse having thin edges. Another way of describing this shape would be to say it is almond shaped. This shape tends to equalize longitudinal and lateral deformation of the stopper when pressure is applied. Another preferred shape is formed by an arc subtended by a chord which also equalizes deformation. An additional way in which horizontal deformation may be limited is to curve the longitudinal edges of the stopper member with a slight radius so that the edge will tend to be stopped by, rather than penetrate the adjoining seal area when being sealed into the container.

An elongate stopper member embodying one or more of the above features may be withdrawn from the container without rupturing either the seal or the container material itself. This helps in packaging sterilized items to insure a sterile dispensing path through the seal for the material contained within the package when expulsion from the container is desired. As mentioned previously, the elongate stopper member may be selected from a plurality of thicknesses and shapes in order to provide the desired size of dispensing orifice for the package.

In a preferred embodiment the container is both sterilizable and sterility maintaining, (able to maintain the product in a sterile condition) after being sealed, in order to package medical products such as sterile saline solution. This solution may be used to cleanse contact lenses, for example, by withdrawing the elongate member from the container and squeezing it, thereby directing a fine stream of the saline solution onto a contact lens. Alternatively, the solution may be dispensed drop by drop.

An additional embodiment of the invention includes a tab hermetically sealed to the container about the outside end of the elongate member. That is, the tab is hermetically sealed on the outside of the package around the portion of the seal area adjoining the elongate member. This tab thus prevents the contamination of that area until the package is opened. As a result, when the tab and outside end of the elongate member are removed, a sterile path for the material within the container is provided.

A further embodiment of the invention includes the use of plural compartments within the container. An elongate member is disposed both between the compartments and transversely through the end seal of the container. Through the use of these plural compartments, a number of different materials may be contained separately within the container. For example, materials may be stored separately and mixed immediately prior to use. A further example of the use of such a container would be the mixing of materials which are reactive or miscible to form another material with short shelf life for point of use application. A single dispensing orifice may be used for both materials.

BRIEF DESCRIPTION OF THE DRAWINGS

FIG. 4 of the drawings is a view of the elongate stopper member in the seal area of the package container;

FIG. 4A is an enlarged sectional view taken along line A—A of FIG. 4;

FIG. 4B is an enlarged sectional view taken along line B—B of FIG. 4;

FIG. 9 of the drawings is a partial sectional view of one embodiment of the invention in which the closure portion of the container is compressed about an elongate stopper member;

FIG. 10 of the drawings is a partial side view of one embodiment of the invention in which a metal band is crimped about the closure portion of the package, with the elongate stopper member thereby frictionally engaged within;

FIG. 11 of the drawings is a view, partly in section, of one embodiment of the invention wherein the elongate stopper member has a series of nodules attached along its length which allow opening and resealing of the container by progressively withdrawing the stopper member;

FIG. 12 is a schematic drawing of a sealing bar prior to exerting pressure against the elongate stopper member during sealing;

FIG. 13 is a schematic drawing of sealing bar means of FIG. 12 in which the sealing bar has been compressed against the elongate stopper member;

FIG. 14 of the drawings shows generally the four stages required to manufacture the container shown in FIG. 1;

FIG. 15 of the drawings show an alternative embodiment of an elongate member sealed into the container.

DETAILED DESCRIPTION OF THE PREFERRED EMBODIMENTS

Figure 1:
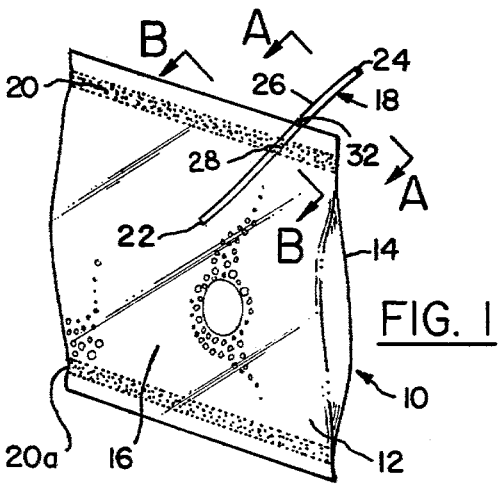
FIG. 1 of the drawings is a perspective view of one embodiment of the invention.

While this invention is susceptible of embodiments in many different forms, there are shown in the drawings and will herein be described in detail several specific embodiments with the understanding that the present disclosure is to be considered as an exemplification of the principles of the invention and are not intended to limit the invention to only the embodiments illustrated.

A container 10 comprises adjacent portions 12 and 14 of sealable material joined together to close container 10 with matter 16 effectively sealed therein. Portions 12 and 14 in a preferred embodiment, may be constructed from flexible plastic sheet (greater than 10 millimeters in thickness), film (less than 10 millimeters in thickness) or tube stock. An elongate stopper member 18 is disposed between adjacent portions 12 and 14 and extends generally transversely through seal 20 between adjacent portions 12 and 14. Adjacent portions 12 and 14 are joined together at seals 20 and **20*a* by fusion, by means of heat sealing, by cement, or adhesives, as desired, so as to tightly grip elongate stopper member 18 at seal 20. Elongate member 18 has one end 22 extending through seal 20 into the container 10 and the other end 24 extending outside the container. This provides a portion 26 which may be grasped so that force may be exerted on it, and the end 22 consequently withdrawn from between sealed portions 12 and 14, leaving an opening 28 into the container through the space formerly occupied by elongate member 18 through which matter 16** within the container may be expelled.

The container 10, shown in FIG. 1, is a flexible envelope preferably formed of heat sealable plastic material. The envelope may be of a single polymer such as polyethylene, polypropylene, polyamide or polyvinylidene chloride or of several copolymers. In addition, a foil laminate may be integrally attached to the film in order to inhibit water vapor transmission. A further advantage of foil laminates is that after opening, the pouch may be folded or crimped several times at the top and thereby be reclosed. The folds may also be held in place by a plastic or metal clip, thereby holding the laminate in a closed position.

Figure 2:
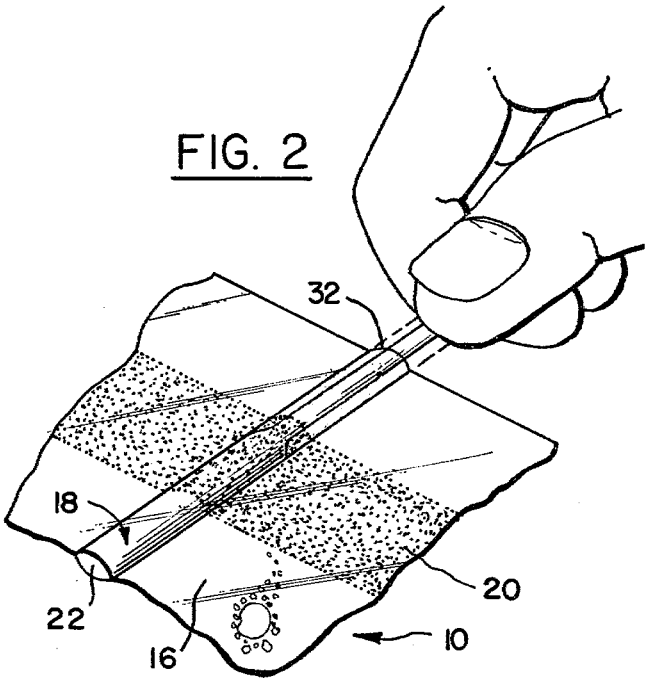
FIG. 2 of the drawings is a front perspective view of the embodiment shown in FIG. 1, showing the elongate stopper member being withdrawn from the container.

As shown in FIG. 2 of the drawings, the elongate member 18 may be pulled away from container 10, thereby deforming elongate member 18 by stretching it away from the container. Upon stretching of elongate stopper member 18 it tends to contract; to become smaller in cross section than the cross section of opening 28 itself. As a result, elongate member 18 may be easily removed thereby, leaving opening 28 open for expulsion of the matter 16 from within container 10. By selection of an elongate stopper member of sufficiently small cross section, opening 28 (created about elongate member 18) may be small enough to allow a fine stream of matter 16 from within container 10 to be directed from the container. Alternatively, matter 16 may be dispensed drop by drop. In one embodiment, the material 16 contained within container 10 may be a sterile saline solution used, for example, to cleanse contact lenses. The saline solution is dispensed onto the contact lens or into a lens carrying case. In this and other embodiments, container 10 is formed of a sterilizable material which maintains the sterility of matter 16 within the container once it is initially sterilized.

It should be noted that when elongate member 18 is withdrawn from container 10, sealing area 20 is not ruptured or torn. Consequently, opening 28 is intact and material 16 may be dispensed through opening 28 without contacting a torn or contaminated area. (A contaminated surface is one which has been exposed to a non-sterile environment.)

In alternative embodiments the container may be used to dispense foodstuffs, such as ketchup, liquid or powdered air freshener, or even an anti-personnel repellant such as a lacrimator like ethanol 2 chloro-1-phenyl; (Mace TM). Similarly, powders such as talc, insect powder or deodorant could be dispensed, or pastes such as toothpastes.

Figure 3:
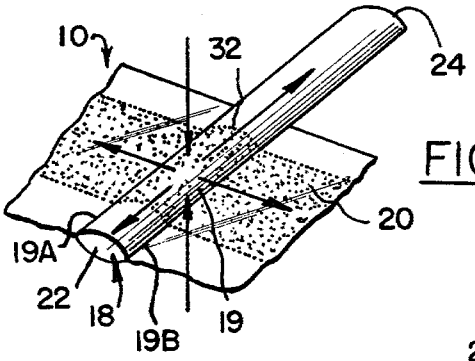
FIG. 3 of the drawings is a perspective view of one embodiment of the elongate stopper member used in the improved dispensing package.

In its preferred embodiment, elongate stopper member 18 is comprised of a flexible elastomeric material, and is greater in length than in thickness. Alternatively, elongate member 18 may be comprised of a flexible plastic material. The member may be of a single or several filaments. Silicone rubber such as Minnesota Rubber Co. No. 71115 compound is a particularly suitable material for elongate stopper member as it effectively resists melting to container 10 when container 10 is sealed and remains elastic and non-brittle at elevated temperatures. It is also sufficiently stretchable to allow easy withdrawal of member 18 from container 10. As shown in FIG. 3, in a preferred embodiment elongate member 18 deforms both longitudinally and laterally when force is applied at the seal area 20 to the member 18. As a result, ends 22 and 24 are displaced away from seal 20 during the sealing procedure and the thickness of elongate member 18 within sealing area 20 is reduced. As shown in FIG. 4, when force is removed from sealing area 20, ends 22 and 24 of member 18 try to contract to their original configuration within sealing area 20 but cannot. This is due to the sealing procedure which constricts the member 18 causing it to be of reduced size in cross section in the opening 28. The elongate member 18 is thus tightly constructed in the opening and acts to form an hermetic (airtight) seal of opening 28. It should be noted that while elongate member 18 is shown in the configuration of a cord, it may also take the form of a plug, a stopper, a cap, an insert, or a body which is sealed to the container having a removable core.

The selection of the cross-sectional shape of the elongate member 18 is instrumental in determining the longitudinal and lateral deformation of elongate member 18 when compressive forces are exerted thereon and the member is sealed within sealing area 20 of container 10. As shown schematically in FIG. 3, during the process of sealing elongate member 18 within sealing area 20 has force applied both from above and below causing elongate member 18 to deform longitudinally and laterally, thereby thinning portion 19 of elongate stopper member 18 within the seal area 20. Another way of describing this would be to say that when a sealing force is applied to portion 19 elongate stopper member from above and below, it causes ends 22 and 24 to move, or deform away from the seal area 20. as a result of this moving away or deformation, when sealing area 20, the space occupied by elongate member 18 in seal area 20 is thinner in cross section than the remainder of member 18. When elongate member 18 trys to return to its original shape within opening 28, it cannot, because it is restricted from doing so by the smaller size of opening 28. As a result, elongate member 18 tightly fills and seals opening 28 into container 10.

Figure 5:
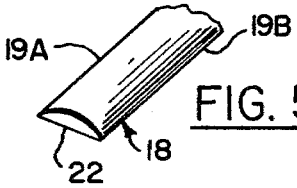
FIG. 5 of the drawings is a perspective view of an alternative embodiment of an elongate stopper member used in the improved dispensing package.

In order to contol both lateral and longitudinal deformation of elongate member when sealing force is applied, elongate member 18 is formed in a number of cross-sectional configurations. For example, as shown in FIG. 3, elongate member 18 may be shaped in cross section as a flat ellipse with pointed ends similar to the cross section of an almond. Due to this somewhat flattened configuration, deformation laterally and longitudinally is equal because, we believe, it is somewhat easier for member 18 to deform towards its ends 22 and 24. Another factor which facilitates such deformation is the fact that elongate member 18 is composed of a material which is not compressible. That is, it can change shape but not volume. Therefore, it deforms longitudinally and laterally when sealing force is applied. Another example of a shape which may be utilized to limit lateral deformation is shown in FIG. 5 of the drawings wherein the cross-sectional configuration of elongate member 18 is the area encompassed by an extremely long arc subtended by a chord to provide one side which is flat and the other side slightly rounded. Again, this somewhat flattened configuration does not allow much lateral deformation. In both the embodiments shown in FIG. 3 and FIG. 5 of the drawings the edges 19A and 19B of elongate member 18 are somewhat sharp rather than rounded. Consequently, as a result of the proper selection of materials and cross-sectional shape, when elongate member 18 is sealed within sealing area 20 of container 10 and sealing pressure is released, elongate member 18 snugly fills opening 28 in the container 10. The thickness and shape of elongate member 18 are designed to provide the desired size of dispensing orifice 32 from container 10.

Figure 6:
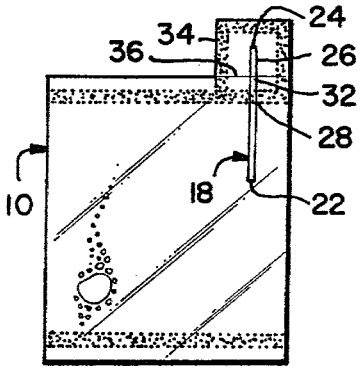
FIG. 6 of the drawings shows a dispensing container including a tab for hermetically sealing the container dispensing area.

As shown in FIG. 6 of the drawings, in an alternative embodiment, container 10 may include a tab 34 sealed to the area 36 adjacent to outer end 26 of elongate member 18. Member 18 is thereby hermetically sealed within container 10 and tab 34. The tab 34 itself, however, is not sealed to elongate stopper member 18. In order to dispense material 16 from container 10, tab 34 is opened, and elongate member 18 withdrawn. If container 10 has been sterilized, area 36 adjacent to outer end 26 of elongate member 18 will remain uncontaminated, until the opening has been closed within tab 34. Material 16 contained within container 10 may then be dispensed through opening 28 and out of orifice 32 without contacting a contaminated portion of the package. This feature is particularly desirable for dispensing sterilized products.

Figure 7:
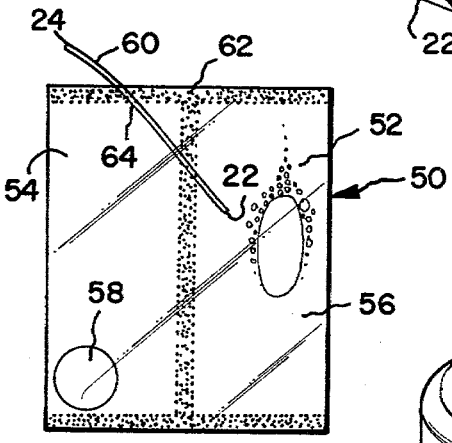
FIG. 7 of the drawings shows an alternative embodiment of the invention including two compartments, each of which may contain separate materials which may be mixed before dispensing.

As shown in FIG. 7 of the drawings, in an alternative embodiment, container 50 includes compartments 52 and 54 for containing and dispensing materials 56 and 58. In the embodiment illustrated, material 56 may, for example, be a liquid and material 58 may be a solid which may be dissolved by the liquid 56. Elongate stopper member 60 extends between compartments 52 and 54 through seal area 62 which separates compartments 52 and 54. When it is desired to use the material 56 and 58, elongate stopper member 60 is partially withdrawn from compartment 52 and into compartment 54. Stopper 60 is also moved partially through seal area 20. The liquid material 56 within compartment 52 may then be dispensed into compartment 54 by squeezing compartment 52 whereby the liquid 56 contacts solid material 58 and dissolves it. The resulting solution may then be dispensed by completely withdrawing elongate stopper member 60 from container 50 thereby leaving opening 64 free for expulsion of the solution.

Figure 8:
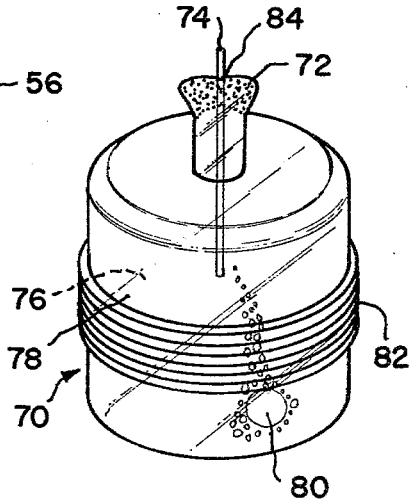
FIG. 8 of the drawings shows an alternative embodiment of the invention including a blow-molded plastic bottle as the container.

As shown in FIG. 8 of the drawings, in an alternative embodiment, container 70 may be a container of any desired type of configuration such as a blow-molded plastic bottle sealed at end 72. Sealed area 72 may be sealed by heat sealing, microwave, adhesive, crimping, or other commonly known means of enclosure. Elongate member 74 extends through the seal 72 from the inside 76 to the outside 78 of container 70 and may be withdrawn in order to expel material 80 contained within container 70. In order to dispense material 80 from the container 70 after member 74 is removed, the container is squeezed thereby collapsing bellows 82 and reducing the volume within container 70. The material 80 is forced from within the container 70 through opening 84.

As shown in FIGS. 9 and 10 of the drawings, while in a preferred embodiment, the entire container 10 may be constructed of a flexible material, in some instances the container 10 may be constructed of a rigid material which may be compressed about the elongate stopper member 18 during the sealing process. This compression may be accomplished through the use of machinery or crimping devices such as a metal band 86 or wire crimp about the closure 88. In these embodiments, stopper member 18 may comprise a substantially rigid material such as a length of metal wire.

As shown in FIG. 11 of the drawings, elongate stopper member 18 may be formed with a series of nodules 92, ripples or bumps along its length either integrally formed or attached thereon. When elongate stopper member 18 is partially withdrawn from container 10, which may be like any disclosed herein, and thin section 94 is within opening 28, material may be dispensed through the opening. The opening 28 may be resealed by pulling elongate stopper member 18 further out of the container 10, causing nodule 93 of member 18 to seal opening 28. Alternatively, a plug could be inserted into opening 28 to reseal the container 10.

Shown in FIGS. 12 and 13 of the drawings are one method of engaging elongate member 18 within container 10. As shown schematically, the elongate stopper member 18 within container 10 is disposed between heat platen 100 and sealing bar means 102. In a preferred embodiment, sealing bar means 102 is comprised of a rubber compound such as silicone rubber, 30–40 Durometer in hardness, of the open cell type supplied by such manufacturers as Dow Corning and Connecticut Rubber which can be selected to deform under pressure as desired. While elongate member 18 tends to deform laterally under pressure, the deformation of sealing bar 102 about elongate member 18 tends to constrict such lateral deformation. As a result, during sealing the force exerted by the sealing bar means 102 tends to eliminate cavities 104 and 106. After sealing when the force is removed, elongate member 18 attempts to return to its original configuration but cannot, due to the tight fit between the member 18 and the container 10. A hermetic seal is thereby provided.

As shown in FIG. 14 of the drawings, the invention includes stages in a method of manufacturing the container 10 previously described. In part (a) of the Figure, adjacent portions 12 and 14 of container 10 are sealed together using conventional sealing techniques such as heat sealing, shortwave, adhesive, impulse sealing or other commonly known methods of enclosure. If container 10 is comprised of sheet material, then the container may be sealed on sides 10A, 10B and 10C or folded and sealed on sides 10B an 10C. If it is comprised of plastic tube stock then it is sealed only along the bottom 10A. In part (b) material 16 is dispersed into container 10 again using conventional filling techniques such as tube type filler 200. In part (c) of the Figure, elongate member 18 is inserted into and held stationary proximate to the top 10D of container 10. Elongate member 18 both extends into and from container 10. Finally, in part (d) container 10 is hermetically sealed across top 10D of the container, in seal area 20, with elongate member 18 tightly engaged therein. As a result, container 10 may be now used to store material 16 until ready for use.

As shown in FIG. 15 of the drawings in an alternative embodiment, elongate member 18 may be sealed within sealing area 20 of container 10 with a removable core section 18A running longitudinally through it. In order to dispense material 16 from container 10, removable core section 18A is removed leaving an opening 18B for the passage of said material 16.

Figure 16:
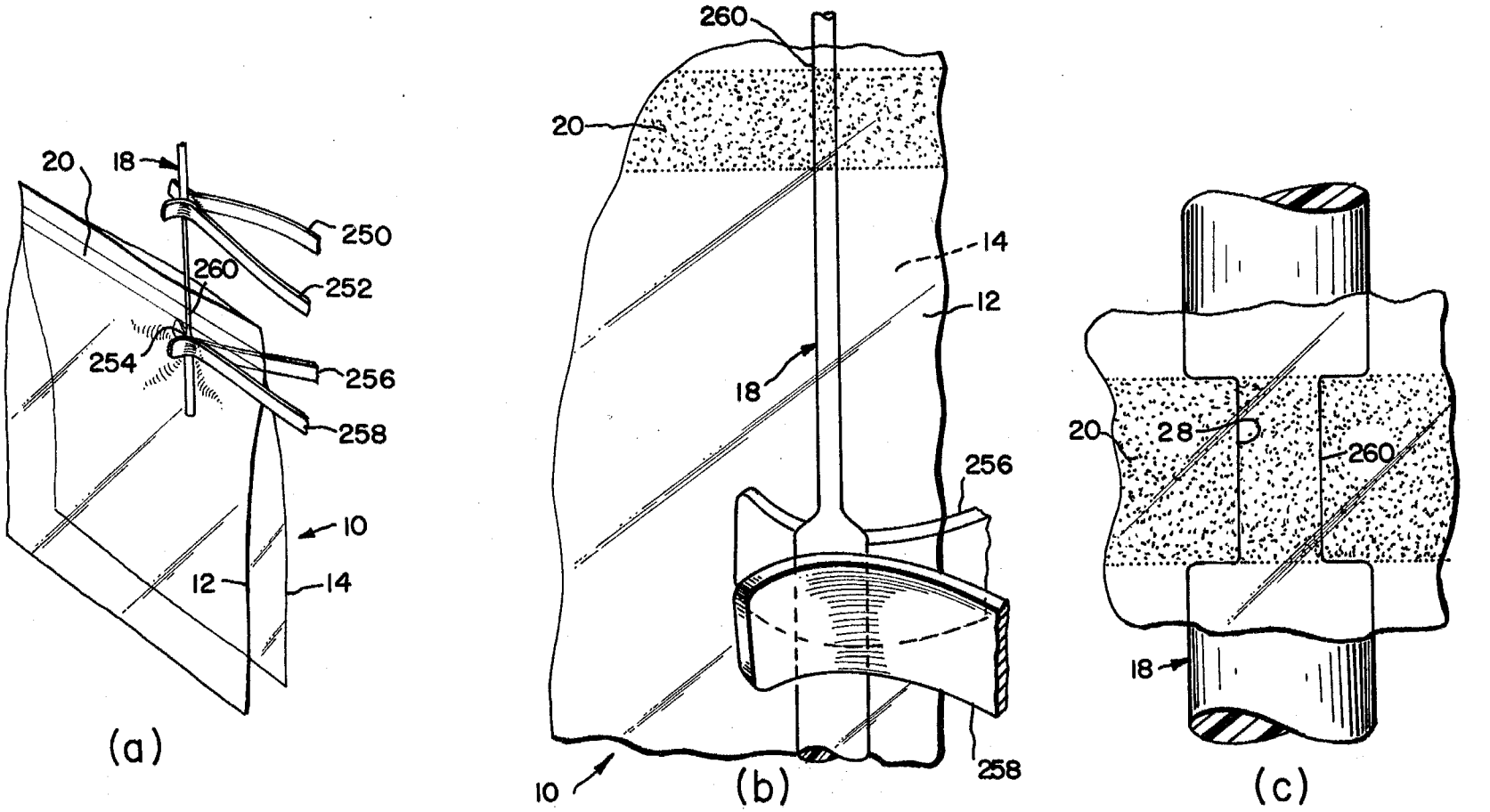
FIG. 16 of the drawings shows another embodiment of the manufacturing method used to produce the container shown in FIG. 1.

As shown in FIG. 16 of the drawings, the invention includes a novel method for manufacturing the container 10 previously described. In part (a) of FIG. 16, elongate deformable member 18 has been inserted into container 10 by gripping arms 250 and 252, or by other appropriate means. Once inserted into container 10, a portion 254 of said elongate deformable member 18 below seal area 20 is gripped between adjacent portions 12 and 14 of container 10 by gripping arms 256 and 258. Alternatively, elongate deformable member 18 may be gripped from within container 10. Gripping arms 250 and 252 are then moved away from gripping arms 256 and 258, thereby stretching elongate deformable member 18.

As shown in part (b), stretching of elongate deformable member 18 reduces the cross-sectional area of portion 260 of elongate deformable member 18 lying in seal area 20. When seal area 20 is then sealed, as shown in part (c), portion 260 remains reduced in cross section. This provides greater compressive force by elongate deformable member 18 against opening 28, since elongate deformable member 18 is elastic and seeks to return to its original cross-sectional configuration. A tighter seal may thereby be provided. As a result, opening 28 may be made smaller by stretching elongate deformable member 18 than if it were sealed in said area 20 without stretching. Alternatively, the stretching of elongate member 18 with its correspondingly greater compressive force allows the use of larger elongate members, and therefore larger openings, when desired.

The foregoing description and drawings merely explain and illustrate the invention and the invention is not limited thereto, except insofar as the appended claims are so limited as those skilled in the art who have the disclosure before them will be able to make modifications and variations therein without departing from the scope of the invention.

I claim:

1. A sealed container for enclosing matter therein, said container including adjacent portions sealed together at a seal area to close said container; and a deformable elastic elongate member having respective portions extending from outside said container through said seal area between said adjacent portions and into said container, said elongate member in its undeformed condition having a substantially uniform cross section in the portions thereof which extend through said seal area and into said container, said elongate member in said seal area and in said container having a cross sectional shape of greater width than thickness and with tapered edges and thereby being configured to facilitate sealing said container as sealing pressure is exerted against said seal area adjacent portions, said elongate member being deformed by said sealing pressure in said seal area to a smaller cross-sectional area than the cross-sectional area of the undeformed member whereby when said sealing pressure is released said elongate member, due to its elasticity, tries to return to its undeformed condition of larger cross-sectional area thereby exerting a positive sealing force against the adjacent portions of the container where said elongate member through said seal area of said container, said portion of said elongate member extending outside said container providing a portion which may be pulled to exert a longitudinal force on said elongate member, thereby stretching said elongate member longitudinally and reducing its cross-sectional area in the seal area to facilitate easy withdrawal of said member without rupturing the seal area and thereby leaving an opening into said container which substantially approximates the cross sectional configuration of the deformed elongate member through which the matter in the container may be expelled.

2. The sealed container for enclosing matter therein as described in claim 1, wherein said elongate member is disposed between and generally transverse to a portion of said seal area between said adjacent portions and said sealed portions are fused together and snugly surround and frictionally engage said elongate member.

3. The invention according to claim 1, wherein the deformation of said elongate member provides an hermetic seal of the opening between said adjacent portions of said container.

4. The sealed container described in claim 1, wherein said elongate member in cross-section has a generally flat elliptical shape with pointed ends.

5. A sealed container described in claim 1, wherein said elongate member is generally shaped in cross-section as a shallow arc subtended by a chord.

6. The sealed container described in claim 1, further including closure means hermetically sealed to said container to enclose the outside end of said elongate member to prevent contamination of the matter enclosed within said container.

7. A sealed container described in claim 1, and further including plural compartment means for individually enclosing material therein, said elongate member being disposed to communicate said plural compartment means with said sealed area whereby when said elongate member is withdrawn from said container a passageway is provided to communicate said plural compartment means and materials enclosed within said compartment means are enabled to be mixed prior to dispensing from said container.

8. The sealed container described in claim 1, wherein said container is a blow-molded plastic bottle sealed at one end with said elongate member provided within said seal.

* * * * *

UNITED STATES PATENT AND TRADEMARK OFFICE

CERTIFICATE OF CORRECTION

PATENT NO. : 4,266,692

DATED : May 12, 1981

INVENTOR(S) : James A. Clark

It is certified that error appears in the above-identified patent and that said Letters Patent are hereby corrected as shown below:

Column 6, line 56, delete "constructed" and substitute therefor --constricted--.

Column 9, line 16, after "10B" delete "an" and substitute therefor --and--.

Column 10, line 30, after "member" insert --extends--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*